US006615907B1

(12) United States Patent
Vølstad

(10) Patent No.: US 6,615,907 B1
(45) **Date of Patent: *Sep. 9, 2003**

(54) STADIUM WITH ICE RINK CHANNEL SYSTEM FOR HEATING AND/OR COOLING

(75) Inventor: Ove C. Vølstad, Kvernaland (NO)

(73) Assignee: Vølstad Energy AS, Kvernaland (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/701,770

(22) PCT Filed: May 20, 1999

(86) PCT No.: PCT/NO99/00161

§ 371 (c)(1),
(2), (4) Date: Dec. 1, 2000

(87) PCT Pub. No.: WO99/66153

PCT Pub. Date: Dec. 23, 1999

(30) Foreign Application Priority Data

Jun. 2, 1998 (NO) ..... 19982521

(51) Int. Cl.[7] ..... F24H 9/06; F24D 19/02; F24D 5/10

(52) U.S. Cl. ..... 165/47; 165/56; 165/53; 62/260

(58) Field of Search ..... 165/45, 47, 56; 62/260; 237/69; 65/53

(56) References Cited

U.S. PATENT DOCUMENTS

| | | | | |
|---|---|---|---|---|
| 1,634,938 A | | 7/1927 | Funk | |
| 3,108,454 A | * | 10/1963 | Raskin | 165/53 X |
| 3,265,121 A | * | 8/1966 | Hickman | 165/53 X |
| 3,538,719 A | | 11/1970 | Pradel | |
| 3,994,278 A | * | 11/1976 | Pittinger | 165/53 X |
| 4,082,080 A | * | 4/1978 | Pittinger | 165/53 X |
| 4,513,583 A | | 4/1985 | Watt | |
| 4,703,597 A | * | 11/1987 | Eggemar | |
| 4,979,373 A | * | 12/1990 | Huppee | |
| 5,327,737 A | * | 7/1994 | Eggemar | |
| 5,709,099 A | * | 1/1998 | Blades et al. | 165/53 X |
| 5,927,022 A | * | 7/1999 | Hirakawa et al. | |
| 6,021,646 A | * | 2/2000 | Burley et al. | 165/45 X |
| 6,035,654 A | * | 3/2000 | Rothe | 165/53 X |
| 6,398,455 B1 | | 6/2002 | V.o slashed.lstad | |

FOREIGN PATENT DOCUMENTS

| | | | |
|---|---|---|---|
| FI | 80670 | | 3/1990 |
| GB | 2210963 | | 6/1989 |
| GB | 2223567 A | * | 4/1990 |
| JP | 9-72642 | * | 9/1995 |
| JP | 9-72641 A | * | 3/1997 |
| WO | 99/01619 | | 1/1999 |
| WO | 99/63179 | | 5/1999 |

* cited by examiner

*Primary Examiner*—Ljiljana Ciric
(74) *Attorney, Agent, or Firm*—Andrus, Sceales, Starke & Sawall, LLP

(57) ABSTRACT

The invention relates to a stadium with an arena (1) such as an ice rink, and surrounding stand (2) for spectators, and to a channel element for a channel system in the arena (1) and the surrounding stand (2). The arena (1) and the stands (2) comprise a channel system each, arranged so that air may be supplied and/or extracted for cooling or heating the arena (1) when the arena (1) is to be iced or de-iced, or so that the stands (2) may be used for heating and/or cooling of the stadium, respectively. Each channel system is made up of a number of channel elements consisting of at least three interconnected layers (3, 4, 5) of corrugated sheet material. The layers (3, 4, 5) are placed at angles in proportion to each other in such a way that corrugations of layers placed one above the other are preferably mutually perpendicular. Thereby channels are interconnected by the intermediate layer (4) being formed with a number of holes (6) extending transversely to, and preferably in a plane through, the mid portion of the layer (4), so that air at a temperature providing heating and/or cooling may be taken through the formed channel system in a controlled manner.

15 Claims, 8 Drawing Sheets

STADIUM WITH ICE RINK CHANNEL SYSTEM FOR HEATING AND/OR COOLING

CROSS REFERENCE TO RELATED APPLICATION

The present application is the U.S. national stage application of International Application PCT/NO99/00161, filed May 20, 1999, which international application was published on Dec. 23, 1999 as International Publication WO 99/66153 in the English language. The International Application claims the priority of Norwegian Patent Application 19982521, filed Jun. 2, 1998.

BACKGROUND OF THE INVENTION

The invention relates to a stadium with arena such as an ice rink and surrounding stand for spectators, and to a channel element for a channel system in a stadium with arena such as an ice rink and surrounding stand for spectators.

In known stadiums the icing is commonly done by means of a refrigerating plant with refrigerating fluid running in a pipe system underneath the floor surface of the arena. The heating and/or the cooling of the stadium is often done by air at a desired temperature being supplied through channels above the stands. A drawback of such dual solutions is that separate systems are required for making or removing ice on/from the arena, and heating and/or cooling the stadium, respectively. This costs money, both in connection with the building of the stadium, and in subsequent running and maintenance. Likewise, such dual solutions provide little possibility of cost-effective utilization of the surplus energy created in the respective part of the stadium. Another drawback is that it takes a very long time to melt the ice again, if the arena is to be us ed for purposes for which there is no need for ice. Further drawback s follow in that the air used for heating or cooling, is supplied in channels which are normally located close to the ceiling of the stadium. This involves, i.a., that the air must have a higher temperature than if it were supplied more at the level of the spectators, it must be supplied at a certain speed which may interfere with the activity on the arena, and space must be provided for the channels. Another extremely problematic condition is the pollution that hazardous chemicals in the coolant may cause, in case of a leak in the pipes.

SUMMARY OF THE INVENTION

An object of the present invention is to provide a more simple and more cost-effective way of building, running and maintaining the systems necessary for quick icing or de-icing of the arena, or for providing heating and/or cooling of the stadium, respectively. Other objects are to take care of the surplus energy gained in the different parts of the stadium, in a more convenient manner. Besides, it is achieved that the heed for energy for the heating or cooling of air, decreases by the air instead being used for heating or cooling the stand themselves. Additionally, the use of hazardous chemicals which were earlier necessary in making the ice, may be avoided.

The above object is realised by the arena and the stand of the present stadium comprising separate channel systems. Each channel system is arranged so, that air may be supplied and/or extracted when ice is being made on, or removed from, the arena, or when the stand are used for heating and/or cooling the stadium, respectively. The channel system is made up of a number of channel elements consisting of at least three interconnected layers of corrugated sheet material. The layers are placed at angles in such a way that corrugations of layers placed one above the other, preferably are mutually perpendicular, and thereby channels are formed by the corrugations of the layers. The channels are connected by the intermediate layer being formed with a number of holes extending transversely to, and preferably in a plane through, the mid portion of the layer, so that air at a temperature adjusted to enable icing or de-icing of the arena, heating and/or cooling of the stadium, respectively, may be taken through the formed channel system in a controlled manner. In addition to the above stadium, the invention also relates to channel elements which are necessary in order to provide the respective channel systems of the arena and the stand. Other is advantageous details of the invention will appear from the following part of the specification and the dependent claims.

BRIEF DESCRIPTION OF THE SEVERAL VIEWS OF THE DRAWING

Referring now to the accompanying figures, preferred, non-limiting embodiments of the invention will now be explained in detail.

DETAILED DESCRIPTION OF THE INVENTION

Figure 1:
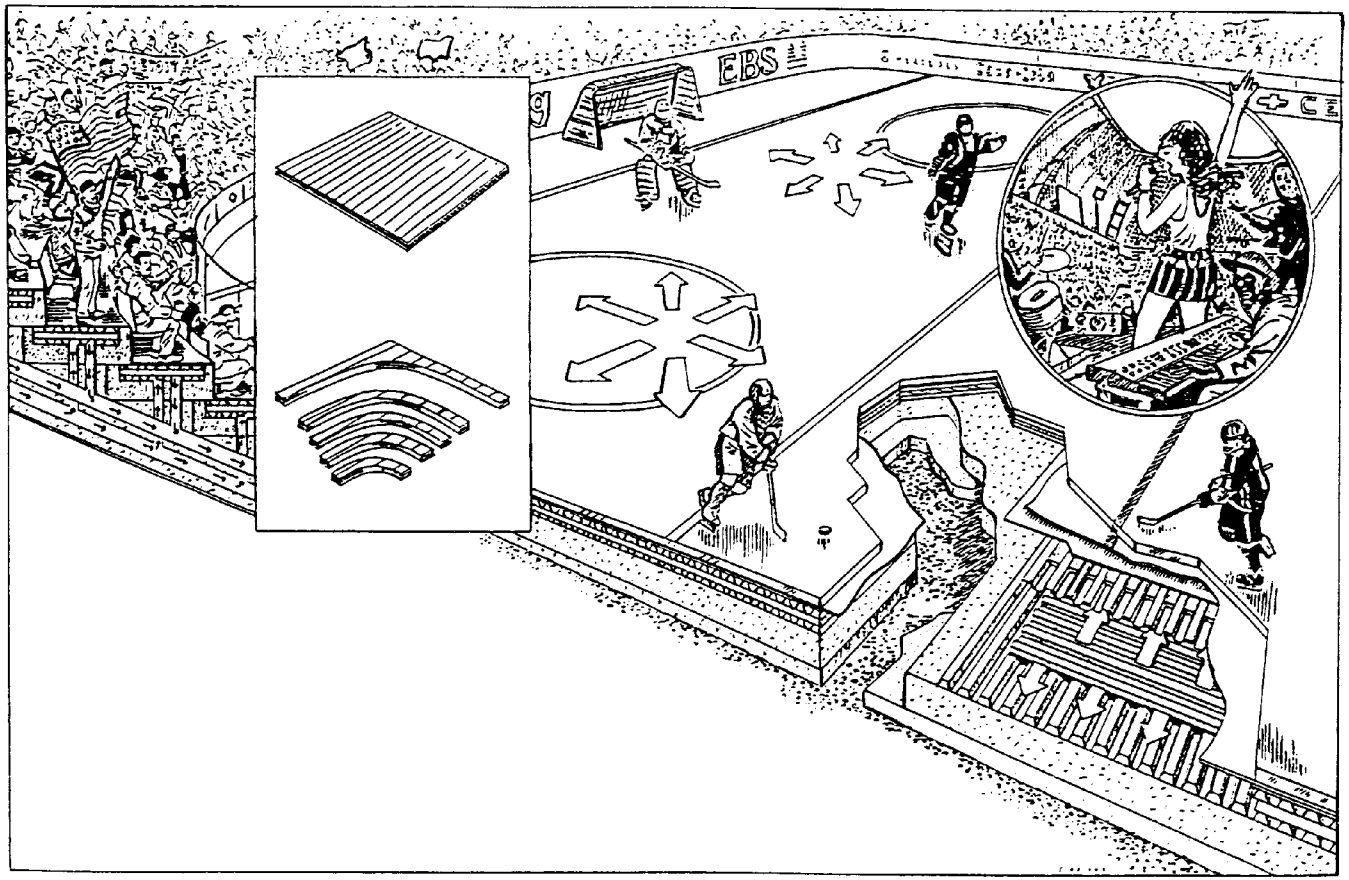
FIG. 1 shows a view of the present stadium in which some important details are described further.
Figure 2:
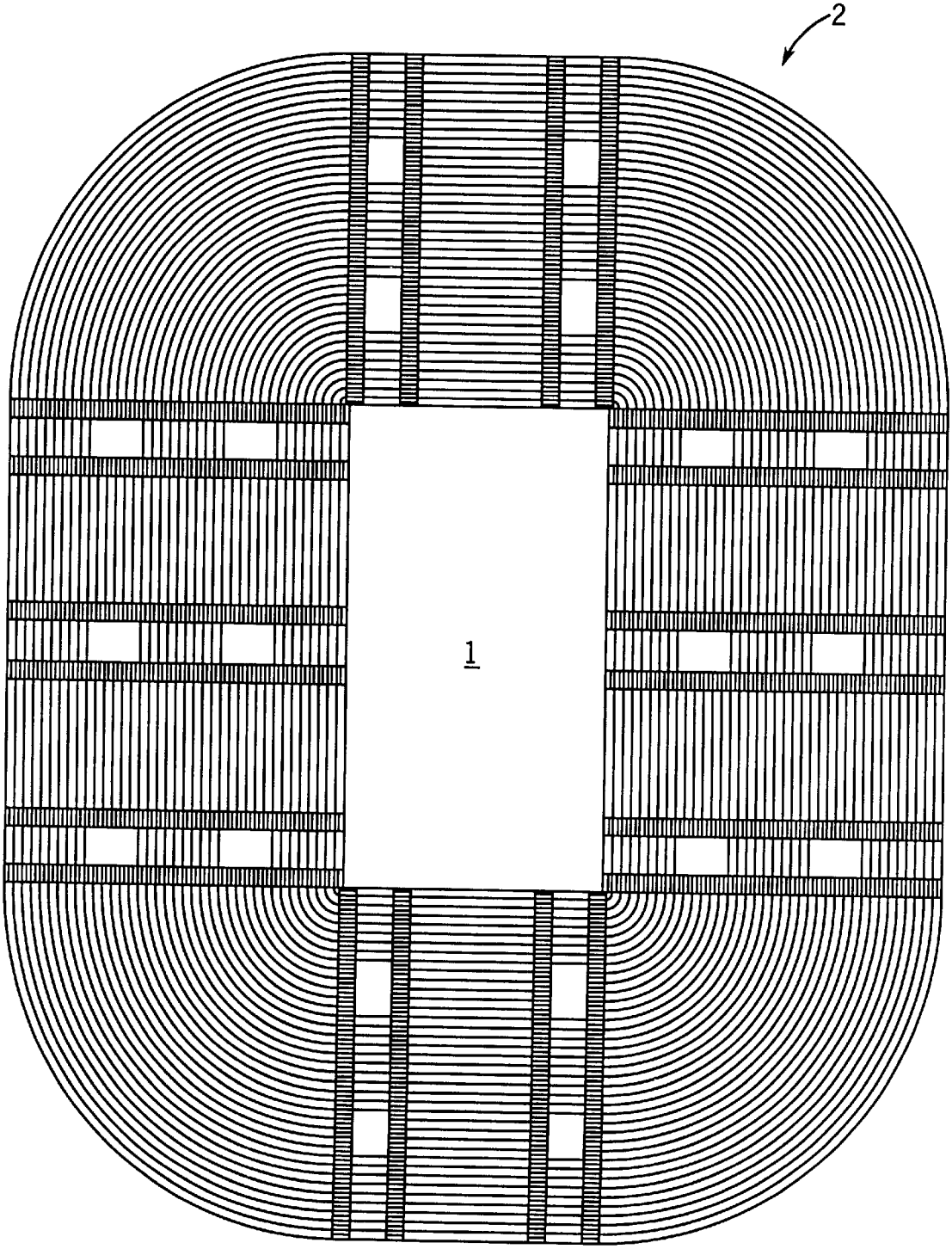
FIG. 2 shows a schematic view of the arena and the stand.
Figure 3:
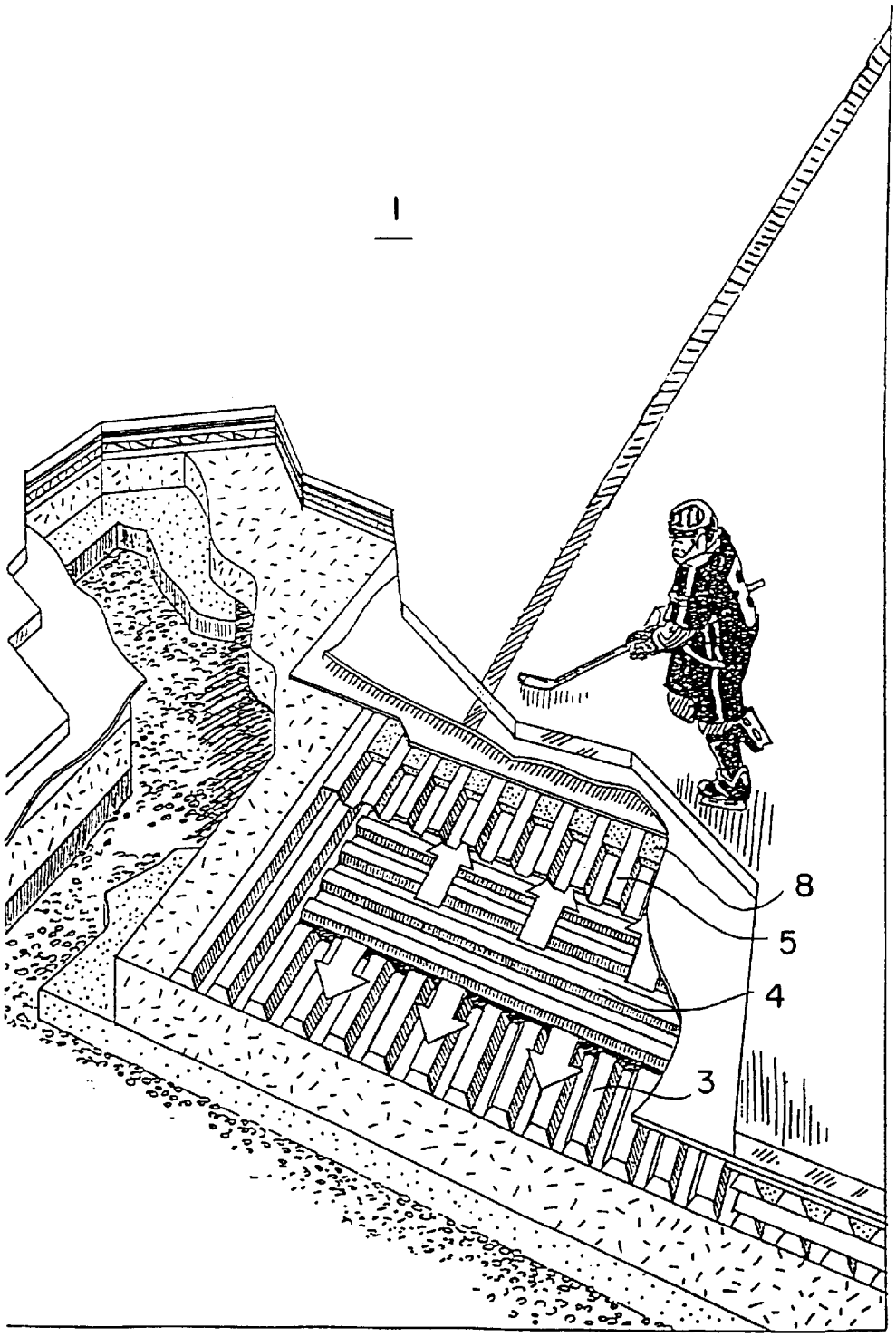
FIG. 3 shows a section describing the configuration of a possible floor construction of the arena.
Figure 4:
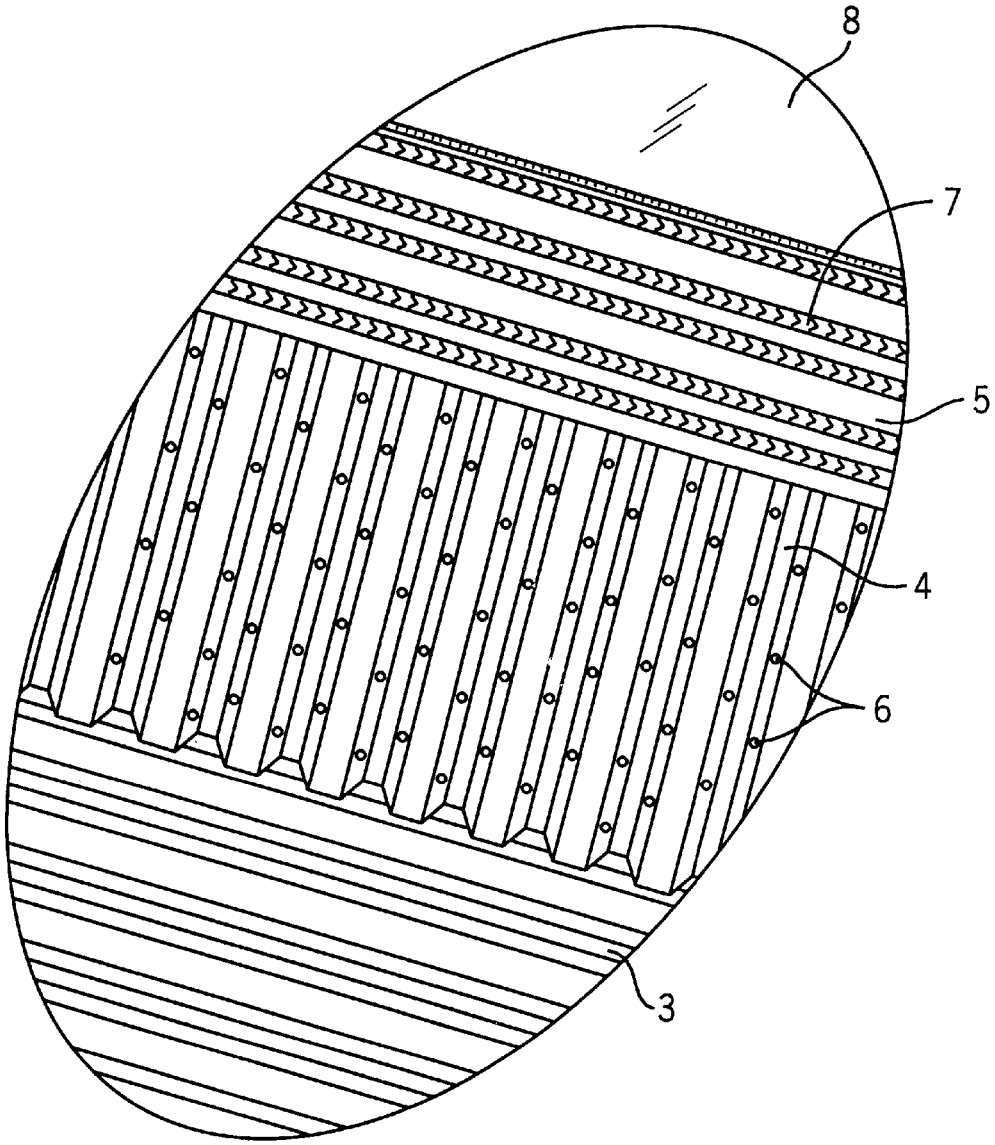
FIG. 4 shows a section of the channel element itself with the different layers of corrugated sheet material.
Figure 5:
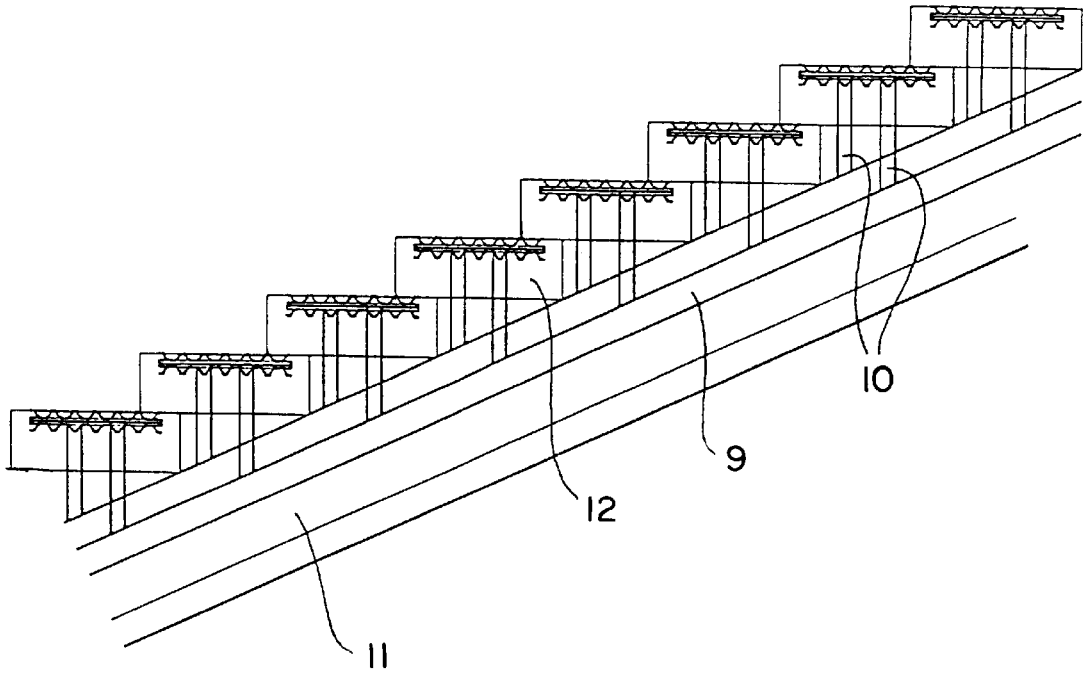
FIG. 5 shows a vertical section through the stands, in which are shown stand elements on an underlying beam provided with channels for supplying and/or extracting air from each channel element.
Figure 6:
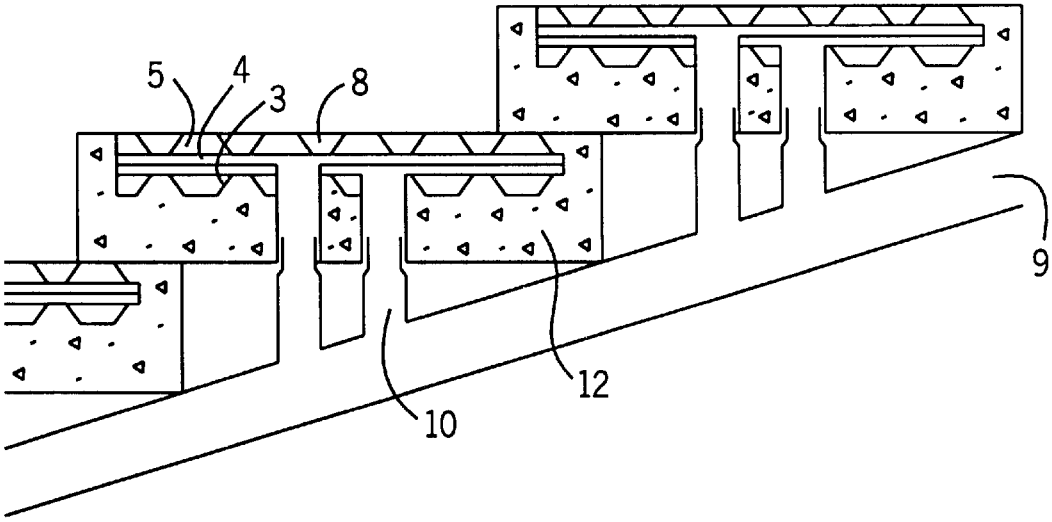
FIG. 6 shows a vertical section showing in further detail how the stand and some pertaining parts car be joined.
Figure 7:
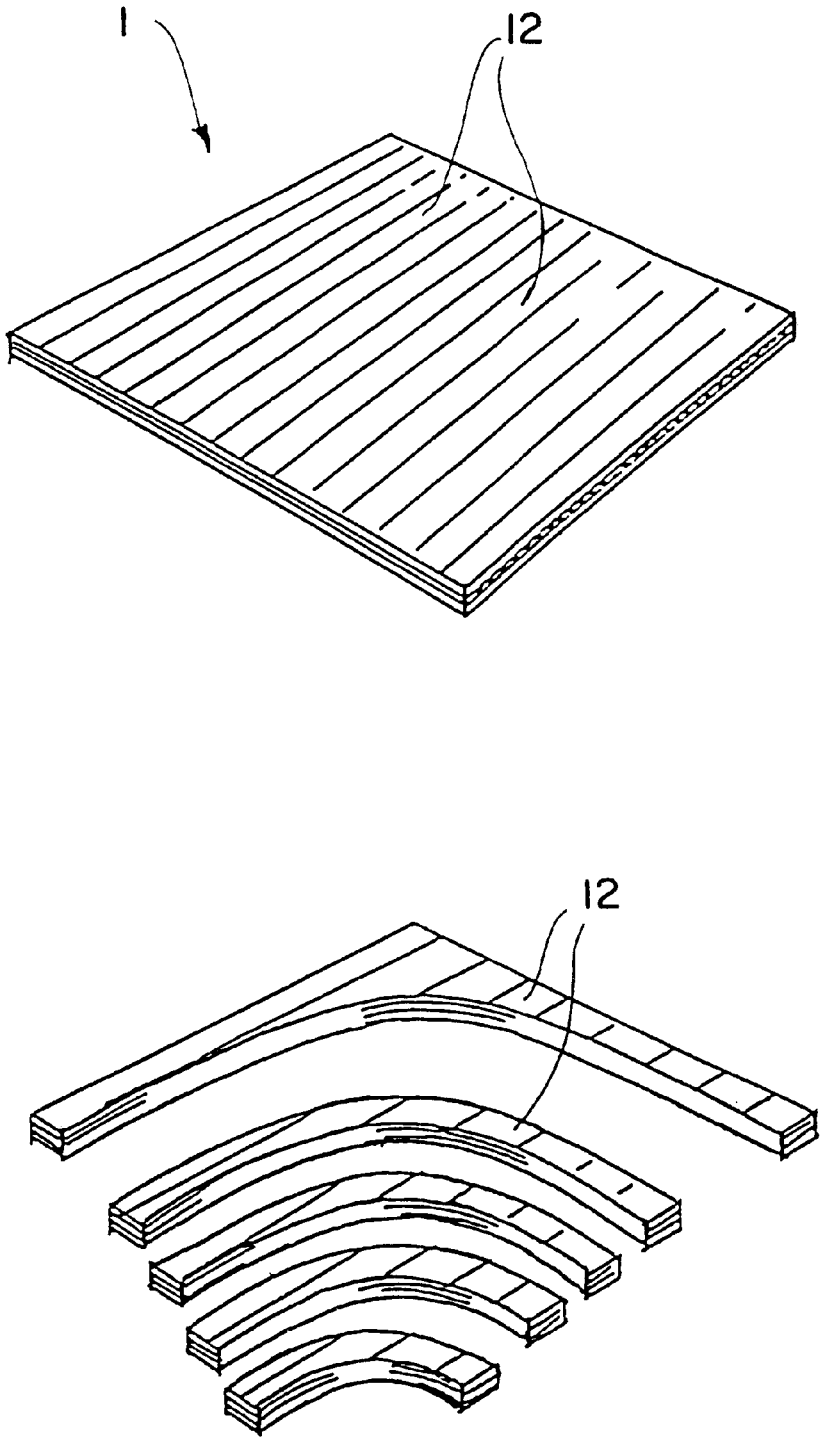
FIG. 7 shows stand elements extending in straight line and curved line, and with a number of stand elements of the straight-line type joined together for the surface forming the arena.

The present stadium comprises an arena 1 in the form of an ice rink with surrounding stand 2 for spectators. The arena 1 as well as the stand 2 are provided with separate channel systems arranged for the supply and/or extraction of air. The air temperature must be such that the arena 1 is cooled or heated when icing or de-icing is to take place or the stand 2 is to be heated and/or cooled, respectively, so that the stadium achieves the temperature expected by the spectators. Each channel system is made up of a number of channel elements consisting of at least three interconnected layers 2, 3, 4, 5 of corrugated sheet material. The layers 3, 4, 5 are placed at an angle in such a way that corrugations of layers, one above the other, are preferably mutually perpendicular. Thereby channels are formed from the corrugations of the layers 3, 4, 5, and the channels are interconnected by the intermediate layer 4 being formed with a number of holes 6. The holes 6 extend transversely to, and preferably in a plane through, the mid portion of the layer 4, so that air at the appropriate temperature may be taken through the formed channel system in a controlled manner.

A person skilled in the art will, without problems, connect the channel system of the arena 1 to the channel system of the stand 2, for example by means of a different type of channels. Air which has obtained an increased temperature through the cooling of the arena 1, may thus be used for heating the stand 2, so that the stadium achieves a desired room temperature. Likewise, air meant for the channel system of the stand 2, may easily be supplied and/or extracted through channels 9, 10 in the underlying parts 11 carrying the stand 2. The channel 10 may for instance be a two-part pipe element extending between the channel 9 in the underlying carrying part 11 and the channel element of the stand.

The channel element of the stand 2 is advantageously embedded in the stand element 12 of e.g. concrete, and the channel element is embedded in such a way that corrugations in the upper layer 5 are filled to a level at least at the height of the corrugation ridges. The stand elements 12 may extend in a straight line or curved line, respectively, depending on whether they are to be used along a longitudinal side or in a bend of the arena 1, respectively. The stand elements 12 may be equipped with suitable connecting means along at least one side edge, so that stand elements 12 of a straight-line extent may be connected to form both a channel system and a floor surface of the arena 1. The channel elements may then be connected by for example horizontally extending pipe elements.

The different layers of the channel element may be mutually connected at points of contact between corrugation valleys and ridges by means of popping, welding, gluing, screwing or similar. The walls of the corrugations of the layers 3, 5, facing the filling 8, may with advantage be formed with embossings 7 projecting either from or into the wall, so that the co-operation between the filling 8 is the best possible one. Besides, the channel element maybe equipped with at least one horizontally and/or vertically extending channel 10 such as a pipe element. The channel element may thus be connected to the channel elements of adjacent stand elements 12 or to at least one underlying channel 9 in a carrying part 11 of the stand 2, possibly in channels under the arena 1 when the stand element is used to provide the channel system of the arena 1.

The configuration of the floor construction of the arena 1 and the embedding of the channel system therein, may, depending on the functional requirements following from the use of the arena, be done in far more ways than what has been described in the above.

Figure 8:
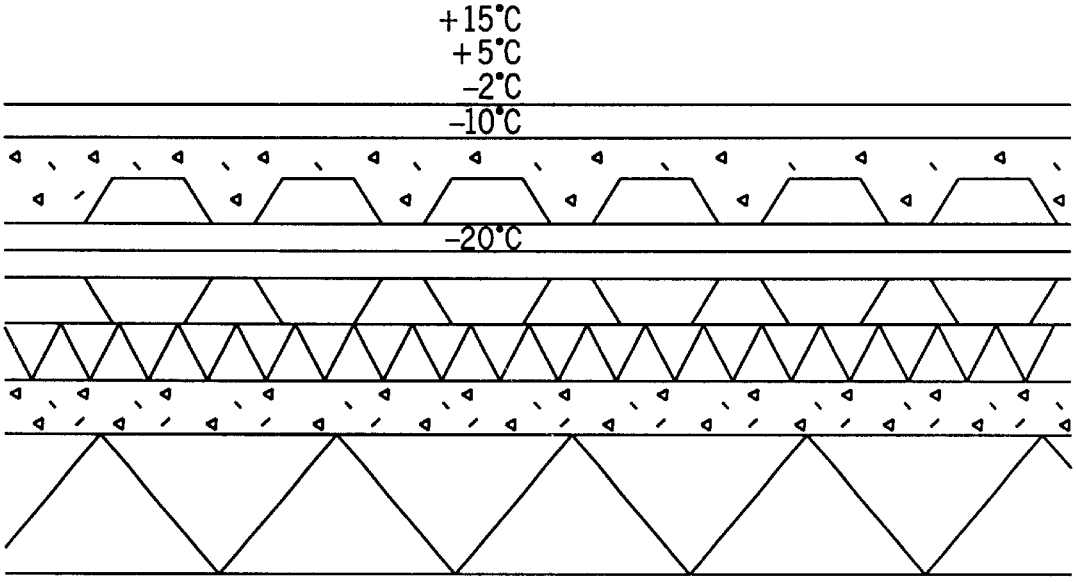
FIG. 8 shows a schematic section through a possible floor construction of the arena with indication of a convenient distribution of temperatures of the channel system, ice and room temperature near the ice surface.

It will not be described any further how air is provided for the respective channel systems, since this is not part of the present invention. However, in FIG. 8 is shown a convenient distribution of temperatures of the channel system, ice surface and the above room temperature. Cooling or heating of the arena 1, heating and/or cooling of the stadium, respectively, takes place by utilization of the difference in temperature of the air in the channel system of the arena 1 and the stand 2, respectively. Thereby is achieved that the arena 1 gets a temperature which allows icing or de-icing of the arena 1. Likewise, depending on whether heating or cooling is to take place, the stand 2 will contribute to the room temperature of the stadium facilities being changed to a desire level. It should be mentioned in particular, that since the spectators visit a stand 2 with increased or reduced temperature, the heating and cooling may take place with less difference in temperature between the supplied air and the stadium than what has been usual in conventional air plants.

What is claimed is:

1. A system for controlling temperatures in a stadium having an arena (1), on which water may be frozen and thawed, and a surrounding stand (2) which is heated or cooled for the comfort of spectators, said system comprising a first channel assembly mounted in heat transfer relationship with the arena; and a second channel assembly mounted in heat transfer relationship with the stand; each of said channel assemblies being formed from at least three, generally contiguous layers (3,4,5) of corrugated sheet material, said generally contiguous layers being arranged in a stack having a pair of exterior layers separated by at least one intermediate layer, the orientation of the corrugations in one layer being perpendicular to the orientation of the corrugations in any adjacent layer for forming a plurality of channels in said generally contiguous layers, said at least one intermediate layer being perforated to interconnect the channels of said layers and to allow air supplied to a first or second channel assembly to circulate through the channels in the layers; said system including means (9, 10) interconnecting said first and second channel assemblies for circulating air between said channel assemblies so that heat supplied to, or extracted from, the air at one of the arena or the stand can be extracted from, or supplied to, the air at the other of the stand or the arena to carry out temperature control in the stadium.

2. A system according to claim 1 wherein said interconnecting means is further defined as means for circulating air between said channel assemblies to transfer heat received by the air at the arena, when water is frozen thereon, to the stand for heating the stadium.

3. A system according to claim 1 wherein the stand has underlying parts (11) supporting the stand (2) and wherein said second channel assembly has at least one conduit (9, 10) in one of said underlying parts for supplying air to said second channel assembly.

4. A system according to claim 1 wherein the stand (2) comprises stand elements (12) and wherein said generally contiguous layers of said second channel assembly are embedded in one of the elements (12) of the stand (2).

5. A system according to claim 4 wherein said stack of generally contiguous layers of said second channel assembly is embedded in one of the elements (12) of the stand (2), the corrugations of an exterior layer of said second channel assembly being filled with an embedding material to render an outer surface of said second channel assembly flush.

6. A system according to claim 4 wherein said second channel assembly is shaped to conform to the configuration of the stand element in which it is embedded.

7. A system according to claim 4 wherein said stand elements include connecting means for said second channel assembly.

8. A system according to claim 4 wherein said second channel assembly is formed of a plurality of channel assembly elements, one of which is embedded in each of the stand elements (12), and wherein said second channel assembly includes conduit means for allowing air to circulate through the channel assembly elements of said second channel assembly.

9. The system according to claim 8 wherein said conduit means is further defined as connecting the channel assembly element of one stand element (12) to the channel assembly element of an adjacent stand element.

10. A system according to claim 1 wherein said conduit means is further defined as connecting a channel assembly element of a stand element to a manifold for the stand (2).

11. A channel assembly for a channel system for controlling temperatures in a stadium by circulating air between an arena (1), on which water may be frozen and thawed, and a surrounding stand (2) which is heated or cooled for the comfort of spectators, said channel assembly comprising at least three generally contiguous layers (3,4,5) of corrugated sheet material, said generally contiguous layers being arranged in a stack having a pair of exterior layers separated by an intermediate layer, the orientation of the corrugations in one layer being perpendicular to the orientation of the corrugations in any adjacent layers for forming a plurality of channels in said generally contiguous layers, said intermediate layer being perforated throughout the extent of the intermediate layer to interconnect the channels of said generally contiguous layers and to allow air supplied to the channel assembly to circulate through the channels in said generally contiguous layers.

12. A channel assembly according to claim 11 wherein said generally contiguous layers (3, 4, 5) of corrugated sheet material are joined together to form said channel assembly.

13. A channel assembly according to claim 11 wherein the corrugations of one of said exterior layers are filled with a filling material to render an outer surface of said channel assembly flush.

14. A channel assembly according to claim 13 wherein the corrugations of said layer of corrugated sheet material containing the filling material contain surface irregularities for engaging said filling material.

15. A channel assembly according to claim 11 wherein said channel assembly includes a conduit means for air circulating through said channel assembly.

* * * * *